United States Patent [19]

Racunas et al.

[11] 4,025,287

[45] May 24, 1977

[54] LIQUID FUEL VAPORIZER DEVICE FOR BAKING FURNACE

[75] Inventors: Bernard J. Racunas, New Kensington; Raymond Kastelic, Lower Burrell, both of Pa.; William L. Proctor, Jr.; George E. Moretz, both of Maryville, Tenn.

[73] Assignee: Aluminum Company of America, Pittsburgh, Pa.

[22] Filed: Dec. 15, 1975

[21] Appl. No.: 640,455

[52] U.S. Cl. ..... 431/189; 431/186; 431/209; 431/347

[51] Int. Cl.[2] ..... F23C 5/06

[58] Field of Search ..... 431/186, 189, 347, 209, 431/242, 247; 239/504, 518

[56] References Cited

UNITED STATES PATENTS

| | | | |
|---|---|---|---|
| 1,384,943 | 7/1921 | Ferguson | 431/209 |
| 3,182,712 | 5/1965 | Zink et al. | 431/347 X |
| 3,212,556 | 10/1965 | Johansson | 431/347 X |
| 3,801,259 | 4/1974 | Hendrick | 431/347 X |
| 3,847,537 | 11/1974 | Velie | 431/347 |

*Primary Examiner*—Edward G. Favors
*Attorney, Agent, or Firm*—Elroy Strickland

[57] ABSTRACT

A device for vaporizing liquid fuel supplied to a furnace chamber. The device comprises a tubular structure having one end adapted to extend into the chamber, and, a plate located over said end, the tube and plate being made of heat resistant materials. Openings are provided in the wall of the tube at locations adjacent and in communication with the plate, the tube being adapted to receive liquid fuel for direction to the plate; the plate, in turn, is adapted to vaporize drops of liquid fuel striking the plate.

6 Claims, 1 Drawing Figure

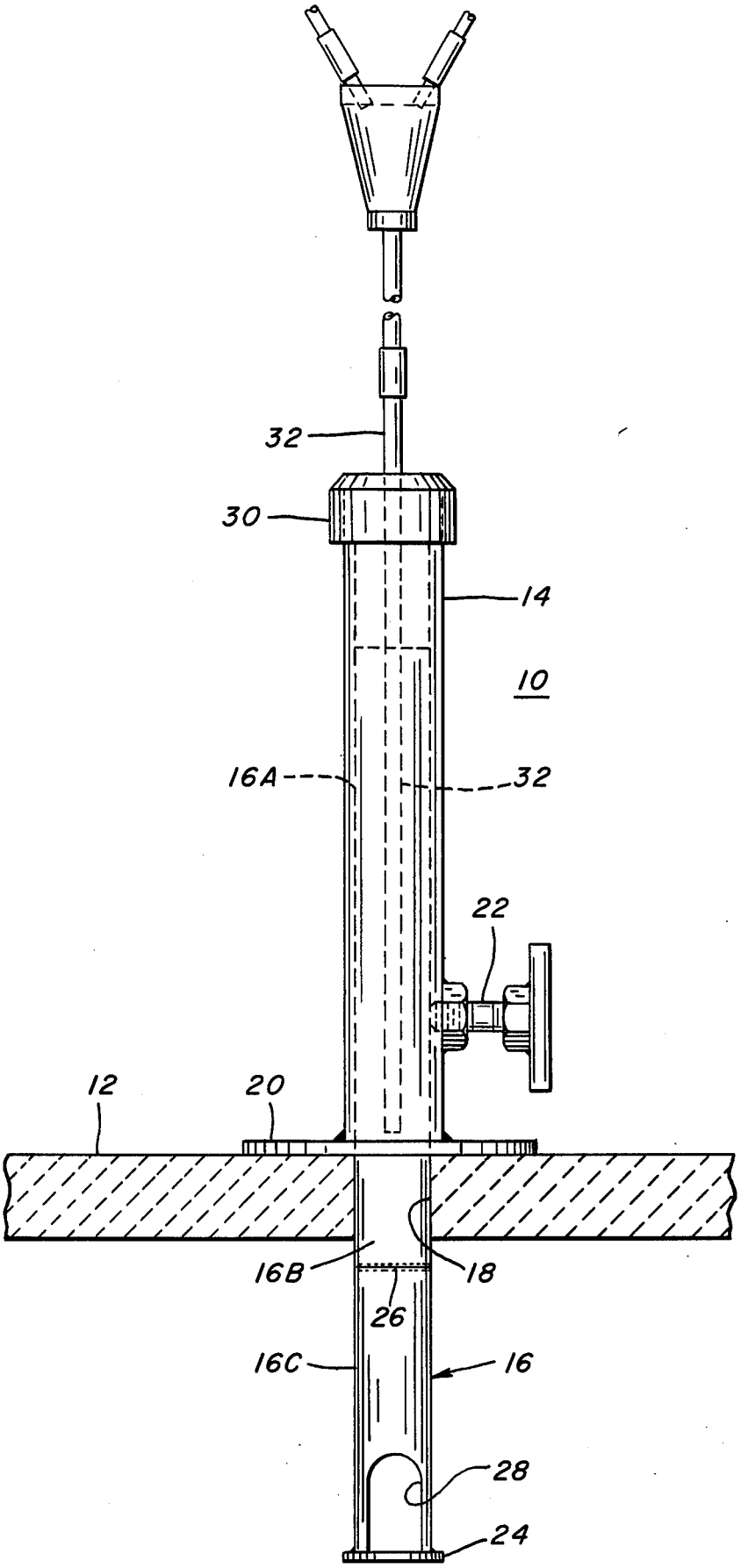
32
30
14
10
16A
32
22
12
20
16B
18
26
16C
16
28
24

LIQUID FUEL VAPORIZER DEVICE FOR BAKING FURNACE

BACKGROUUND OF THE INVENTION

The present invention relates generally to means for feeding fuel to furnace structures, and particularly to a simple and inexpensive device for vaporizing liquid fuel, such as a fuel oil and water mixture, directed to a furnace chamber in an improved and efficient manner.

With the shortage of natural gas, industry, in particular, has had to resort to the use of other fuels, such as coal and oil for its fuel requirements. In ring furnace flues employed to bake carbon electrodes used in electrolytic cells, such as shown and described in U.S. patent application Ser. No. 570,730, now Pat. No. 3,975,149, filed Apr. 23 of this year in the names of B. J. Racunas and R. Kastelic, two of the present applicants, fuel oil has been used in place of natural gas, the fuel oil being admitted to the flues via open troughs extending into the flues through port openings existing in the furnace cover at locations over headwall partitions between adjacent flues. While such troughs are useful in supplying the need of means to feed and vaporize liquid fuel within a furnace in place of natural gas, certain disadvantages are attendant with the use of such troughs for reasons presently to be explained.

Firstly, such open troughs generally comprise a finite length of an open, semi-circular or angled (in cross section), trough-like structure. This structure may be bent by hand to provide a curved structure that is then inserted into the furnace, the open face of the trough facing in an upward direction. Liquid fuel, such as a fuel oil, is supplied to the trough structure with water. The workman in inserting the trough into its respective furnace, provides little or no consistent control over the location of the trough within the furnace, so that optimum locations and burning conditions are generally not achieved, this resulting in inefficient burning of the liquid fuel directed to the trough device. For example, the fuel oil fed to the device tends to reside therein for a period of time sufficient to subject the fuel to cracking phenomena which results in the lighter constituents of the oil being vaporized while the heavier constituents collect in the trough in the form of carbon deposits. This requires frequent removal and cleaning of the troughs.

Because burning of the liquid fuel tends to be inefficient with the use of open troughs, fuel consumption is higher than necessary and the flame pattern inconsistent. Further, since, in a ring furnace, the trough has to be inserted through the furnace cover over the headwall partition between each two adjacent furnaces and associated tie bricks, the trough is often difficult to insert. The workman, for example, often has to remove and rebend the trough in order to direct it past the tie bricks, indicating again the lack of consistent control that is attendant with the use of such troughs. Also, the heat within the furnaces rises through the headwall openings adding to the difficult, environmental conditions encountered in using a curved trough.

BRIEF SUMMARY OF THE INVENTION

The present invention involves the use of a simple, straight, tubular structure supported on the upper, refractory wall of a furnace and extending into the chamber of the furnace through a peep hole ordinarily provided in the upper wall. A plate is mounted over the end of the tubular structure within the furnace, and openings are provided in the wall of the structure at locations closely adjacent the plate, or between the lower end of the structure and the plate. Drops of liquid fuel (with water to enhance vaporization) are directed into the upper end of the tube and permitted to fall under the force of gravity against the plate. When the drops of fuel strike the plate, the drops scatter and rapidly vaporize and pass into the flame area (within the furnace) through the openings provided in the tube wall or between the tube end and plate, the temperature of the plate being close to the firing temperature of the furnace.

The tubular device of the invention has proven to use substantially less fuel oil (fifteen to twenty percent less in ring furnaces). Further, the device is easy to install and remove from furnaces since it is simply disposed in a furnace by dropping it through the furnace peep hole. In addition, the device produces a more constant flame pattern than the trough, which, in turn, provides better heat distribution within furnaces, as explained in detail hereinafter. In addition, there is reduced sooting and the depositing of carbon over that of the curved trough, for reasons explained hereinafter.

THE DRAWING

The advantages and objectives of the invention will be better understood from the following detailed description when considered in connection with the accompanying drawing in which the sole FIGURE is a side elevation view of the vaporizing device of the invention mounted on the upper wall (in section) of a furnace structure.

PREFERRED EMBODIMENT OF THE INVENTION

Referring now to the drawing, the sole FIGURE thereof shows a tubular device 10 vertically disposed in the upper, horizontal wall 12 of a furnace structure not otherwise shown in the FIGURE.

As shown, the device 10 comprises an outer tube 14 located above furnace wall 12, and an inner tubular member 16, with an upper portion 16A, extending into the outer tube, and a lower portion 16B extending vertically into the furnace through an opening 18 in the furnace wall. When the device 10 is inserted into opening 18, the upper tube 14 rests on the upper surface of the furnace wall, as shown, and many include a plate 20 attached to the lower end of tube 14 to insure retention of the tube on the furnace wall.

The inner tube 16 is, in turn, adjustably held within the outer tube by a set screw means 22 extending horizontally through the wall of tube 14 to engage the wall of the inner tube.

Over the lower end of tube 16 is located a plate or disc 24, the plate or disc preferably being attached to the tube by welding, though the invention is not limited thereto. For example, the plate may be spaced from the end of the tube, and attached thereto by weldable straps or other suitable means.

The plate 24 and tube 16 (and the means used to attach the plate and tube together) are made of a material that can withstand the heat and flames within a furnace, stainless steel being one such material. Upper tube 14, however, may be made of a less critical and less costly material, such as black iron. Similarly, the upper portion of lower tube 16, including the portion located in and immediately below opening 18 in furnace wall 12 may also be made of a less critical and costly material since such a portion is somewhat remote from the flame area within a furnace. If such a material is used, the extreme lower portion of tube 16, i.e. portion 16C, may be a stainless steel tube or pipe welded or otherwise joined to the less costly tube portion, line 26 in the FIGURE indicating the location of joining.

Openings or notches 28 (only one of which is shown in the FIGURE are provided in the wall of tube 16 at the end thereof adjacent and in communication with plate 24. For narrow ring furnaces of the type disclosed in the above Racunas and Kastelic application, two, opposed and relatively large openings or notches 28, facing in a lengthwise direction of the furnace flue are preferred for reasons explained hereinafter.

The upper end of upper tube 14 may be closed off by a cap 30, cap 30 being provided with an openinng (not visible in the FIGURE to receive a pipe or tube 32. As shown, the cap centers pipe 32 in tube 14, with pipe 32 extending a substantial distance into tube 14 and into tube 16, as shown in dash outline. As shown, pipe 32 is also centered over plate 24.

In the operation of device 10, it is inserted vertically into the chamber of a furnace, drops of liquid fuel, and preferably water added concurrently with the oil, or in the form of an oil-water emulsion, are supplied to device 10 by pipe 32. The drops of oil and water fall under force of gravity to strike plate 24 located at the lower end of tube 16. When the drops strike the plate, which is at or near the temperature within the furnace, the oil and water vaporize and pass from tube 16 through opposed openings 28 into the flame area within the furnace to burn therein. Preferably, the drops of fuel and water strike a central location on plate 24 so that vaporized fuel and water are distributed through opposed openings 28 in 16C into the furnace. Particularly, for narrow furnace flues, with the opposed facing in a lengthwise direction of the flues, the vaporized fuel and water entering the flues from the opposed openings provide a distributed flame pattern in the flue, which in turn, improves the distribution of heat within the flues.

Because the drops of fuel strike at one predetermined, constant location (i.e. plate 24) within a furnace, scattering and vaporization of the fuel is consistent so that control of fuel burning within the furnace is consistent. When the optimum location for plate 24 (and burning) is chosen within a given furnace, the consistency of burning provided by the device of the invention provides a substantially improved, efficient utilization of the fuel so that soot and carbon formation on plate 24 and in tube 16 is minimized.

Water, being introduced with the oil or as an ingredient of the oil, as in the case of an oil-water emulsion, forms steam which aids in the evaporation of oil as well as restricting temporarily the combustion of the oil so that combustion takes place over a large area within the furnace of flue, as the oil and water vapor travels outwardly from plate 24. The tendency of concentrated, fireball combustion that occurs in conventional oil burners, in which the oil is injected under pressure, is thus substantially reduced if not eliminated altogether. This enhances the even distribution of heat in the furnace, as discussed above in connection in long, relatively narrow flues employed to bake carbon electrodes.

Further, though the length of the lower tube portion 16B can be precisely chosen for optimum location and burning for a particular furnace or furnace design, the device depicted in the drawing has an adjustable feature that provides the device with additional flexibility, i.e., the location of plate 24 and thus fuel scatter and vaporization, can be precisely positioned within a given furnace by simply loosening set screw 22 and raising or lowering tube 16 within tube 14, as needed. Also, by properly locating the lower portion of the device in a furnace, where temperature and conditions are less severe, the life of the lower tube portion and plate is prolonged.

While the invention has been described in terms of preferred embodiments, the claims appended hereto are intended to encompass all embodiments which fall within the spirit of the invention.

Having thus described our invention and certain embodiments thereof, we claim:

1. A device for vaporizing liquid fuel supplied to a furnace chamber under force of gravity, said device comprising an elongated tube adapted to extend vertically into a furnace chamber so that a lower end of the tube is located within the chamber, a plate covering said lower end, said tube and plate being made of a heat resistant material, openings provided in the wall of said tube at locations closely adjacent said plate, means on the other, upper end of said tube for receiving liquid fuel for vertical direction to and against said plate.

2. The device of claim 1 in which the tube comprises two tube portions, one of which is telescoped and adjustably held within the other tube portion, and, means adjustably holding the one tube portion within the other tube portion.

3. The device of claim 1 including means associated with the tube for supporting the same within an opening provided in an upper wall portion of a furnace structure.

4. The device of claim 1 in which the liquid fuel includes a blend or emulsion of fuel oil and water.

5. In combination, a furnace having an upper, horizontal wall portion provided with a relatively small opening, a tube extending vertically into the interior of said furnace through said opening such that a lower end of the tube is located within the furnace, conduit means associated with the other end of said tube for directing liquid fuel vertically into the tube, a plate covering the lower end of the tube, said tube and plate being made of a heat resistant material, openings provided in the wall of said tube closely adjacent the plate, the plate being adapted to receive thereagainst liquid fuel directed vertically thereto through said tube and under force of gravity, said plate being effective to cause rapid vaporization of the fuel directed thereagainst and thus controlled combustion of the fuel within the furnace.

6. The combination of claim 5 in which the end of the tube located within the furnace is positioned at an optimum, predetermined distance below the upper wall portion of the furnace.

* * * * *